US009434526B2

(12) United States Patent
Son

(10) Patent No.: US 9,434,526 B2
(45) Date of Patent: Sep. 6, 2016

(54) MIXING CONTAINER FOR DIFFERENT CONTENTS

(75) Inventor: Su-jin Son, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 13/879,774

(22) PCT Filed: Nov. 22, 2011

(86) PCT No.: PCT/KR2011/008920

§ 371 (c)(1),
(2), (4) Date: Apr. 16, 2013

(87) PCT Pub. No.: WO2012/070843

PCT Pub. Date: May 31, 2012

(65) Prior Publication Data

US 2013/0228482 A1 Sep. 5, 2013

(30) Foreign Application Priority Data

Nov. 22, 2010 (KR) ..... 10-2010-0115971

(51) Int. Cl.

| | |
|---|---|
| ***B65D 25/08*** | (2006.01) |
| ***B65D 81/32*** | (2006.01) |
| ***A45D 34/00*** | (2006.01) |
| ***A45D 34/04*** | (2006.01) |
| *B05B 11/00* | (2006.01) |

(52) U.S. Cl.

CPC ..... *B65D 81/3266* (2013.01); *A45D 34/00* (2013.01); *A45D 34/04* (2013.01); *B05B 11/0083* (2013.01); *B05B 11/3047* (2013.01); *B05B 11/3069* (2013.01); *A45D 2200/058* (2013.01); *B05B 11/0043* (2013.01); *B05B 11/0048* (2013.01); *B05B 11/3023* (2013.01)

(58) Field of Classification Search

CPC ..... B65D 81/3266; B65D 81/325; B65D 81/3255; B65D 81/32; B65D 51/28

USPC ..... 206/219, 221; 366/130; 222/153.05, 222/153.06, 153.07

See application file for complete search history.

(56) References Cited

U.S. PATENT DOCUMENTS

| | | | | |
|---|---|---|---|---|
| 4,727,985 | A * | 3/1988 | McNeirney et al. | 206/221 |
| 5,306,125 | A * | 4/1994 | Weag | 417/472 |
| 5,884,759 | A * | 3/1999 | Gueret | 206/222 |
| 6,148,996 | A * | 11/2000 | Morini | 206/222 |
| 6,708,846 | B1 * | 3/2004 | Fuchs et al. | 222/82 |

(Continued)

FOREIGN PATENT DOCUMENTS

| | | |
|---|---|---|
| JP | 2008-30847 A | 2/2008 |
| JP | 2008-56299 A | 3/2008 |

(Continued)

OTHER PUBLICATIONS

International Search Report for PCT/KR2011/008920 filed on Nov. 22, 2011.

*Primary Examiner* — Anthony Stashick
*Assistant Examiner* — James M Van Buskirk

(57) ABSTRACT

According to the present invention, a mixing container for different contents, when not being used, prevents a content stored in a storage compartment from being mixed with a content stored in a receiver member. When the mixing container is used, a button part is simply manipulated to open a lower portion of the receiver member, thereby mixing the two contents. Thus, the mixing container can mix different contents in a simple structure.

5 Claims, 10 Drawing Sheets

(56) References Cited

U.S. PATENT DOCUMENTS

| | | | | |
|---|---|---|---|---|
| 7,367,709 | B2 * | 5/2008 | Ki | 366/130 |
| 2008/0000933 | A1 * | 1/2008 | Marelli | 222/321.7 |

FOREIGN PATENT DOCUMENTS

| | | | |
|---|---|---|---|
| KR | 20-0297647 | Y1 | 12/2002 |
| KR | 20-0416576 | Y1 | 5/2006 |

* cited by examiner

MIXING CONTAINER FOR DIFFERENT CONTENTS

TECHNICAL FIELD

The present invention relates to a mixing container for different contents, and in particular to a mixing container for different contents which makes it possible to easily mix two contents since a lower side of a receiver member opens through a simple work of a button part when in use while a content stored in a storage compartment and a content stored in a receiver member don't mix when not in use.

BACKGROUND ART

Some cosmetics are designed to be used in such a way to mix powder or liquid components so as to obtain a special effect, for example, when obtaining a whitening effect in a paste type basic component. In the above mentioned cosmetics, basic components and powder or liquid components may easily go bad when they are previously mixed and stored, so such components should be instantly mixed by a user when using them.

According to the Korean utility model registration number 20-0266847 invented by the same applicant as the present invention, the mixing cosmetic container for different contents has features in that a dispenser is formed of a main container 2 storing a first content, and a dispenser cap 10 engaged to the top of the main container 2. An assistant container 20 is engaged to between the main container 2 and the dispenser cap 10 for storing a second content, with a bottom surface 22 being provided in the assistant container 20 and being designed to be broken by a certain pressure. At an upper rim portion of the assistant container 20 is provided a spacing member 30 which can be cut off when in use, and at the top of the assistant container 20 is provided a push member 40 which descends when the spacing member 30 is removed and breaks the bottom surface 22 of the assistant container 20. When the push member 40 is pressed after the spacing member 30 is removed, the bottom surface of the assistant container 20 is opened by the push member 40, and the second content stored in the assistant container 20 comes to mix with the first content stored in the main container 2.

The conventional cosmetic container capable of mixing contents has basic features in that when the spacing member 30 is removed, the push member 40 descends, and the bottom surface 22 of the assistant container 20 is broken. In other words, for the sake of the above-described operations, there are the push member 40 descending to break the bottom surface 22, the spacing member 30 for the descending movement of the push member 40, and a structure helping mix the first and second contents while forming a space for the movement of the push member. The above-described constructions appear to be complicated, which results in the increased manufacture cost and manufacture time.

Thanks to the small size of the cosmetic container, it is hard to make the descending distance of the push member 40 longer, so there must be a limit in the descending pressure, so the bottom surface 22 does not break as planned.

DISCLOSURE OF INVENTION

Accordingly, the present invention is made to improve the above mentioned problems encountered in the conventional art and other problems. It is an object of the present invention to provide a mixing container for difference contents which makes it possible to easily mix two contents since a lower side of the receiver member can easily open through a simple work of the button part when in use while the content stored in the storing compartment and the content stored in the receiver member don't mix when not in use.

To achieve the above objects, there is provided a mixing container for different contents, comprising a housing 100 having a storing compartment 110 storing contents, a piston 120 being installed in the interior of the storing compartment 110; a guide bracket 200 which is engaged to the top of the housing 100, an engaging shoulder 210 protruding toward the inner side of the storing compartment 110, a guide piece 220 formed at the top of the guide bracket and extending upward; a button part 300 operating as it is inserted in the guide piece 220 and having a pumping member 320 for the content to discharge through a discharge port 310 by a user's work; a sealing ring 400 which is installed to selectively part between the guide bracket 200 and the button part 300; and a storing container 500 comprising a receiver member 510 which is installed at the button part 300 and contains a content which is different from the content stored in the storing compartment 110, the lower side of the receiver member 510 being supported by the engaging shoulder 210; and a sealing member 520 which selectively seals the lower side of the receiver member 510 and is engaged to the lower side of the pumping member 510 and has a communication hole 521 allowing the pumping member 510 and the storing compartment 110 to communicate during the pumping of the pumping member 510.

In addition, the button part 300 comprises a guide groove which is engaged with the guide piece 220 and has an opened lower side for the same to move up and down; and an insertion groove 340 the lower side of which is open, the receiver member 520 being inserted in the insertion groove 340.

According to another embodiment of the present invention, there is provided a mixing container for different contents, comprising a housing 100 having a storing compartment 110 storing contents and a protrusion part 130 on an upper outer surface of which are formed threads; a button part 300 which is engaged with the protrusion part 130 and has a pumping member 320 for the content to discharge through the discharge port 310 by a user's work; a sealing ring 400 which is installed to selectively part between the housing 100 and the button part 300; and a storing container 500 comprising a receiver member 510 which is engaged to the protrusion part 130 and extends into the interior of the storing compartment 110 for thereby storing a content which is different from the content stored in the storing compartment 110; and a sealing member 520 which selectively seals the lower side of the receiver member 510 and is engaged with the lower side of the pumping member 320 and has a communication hole 521 configured for the pumping member 320 and the storing compartment 110 to communicate.

There is further provided a fixing shoulder 530 provided at the top of the storing container 500 for the container 500 to be fixed at the top of the housing 100.

In addition, the content stored in the storing compartment 110 is liquid, and the content stored in the interior of the receiver member 510 is one among liquid, powder and solid.

There is further provided a parting handle 410 in the sealing ring 400 for easier parting work.

ADVANTAGEOUS EFFECTS

The present invention makes it possible to easily mix two contents since a lower side of the receiver member can easily open through a simple work of the button part when in use while the content stored in the storing compartment and the content stored in the receiver member don't mix when not in use.

BEST MODES FOR CARRYING OUT THE INVENTION

Figure 1:
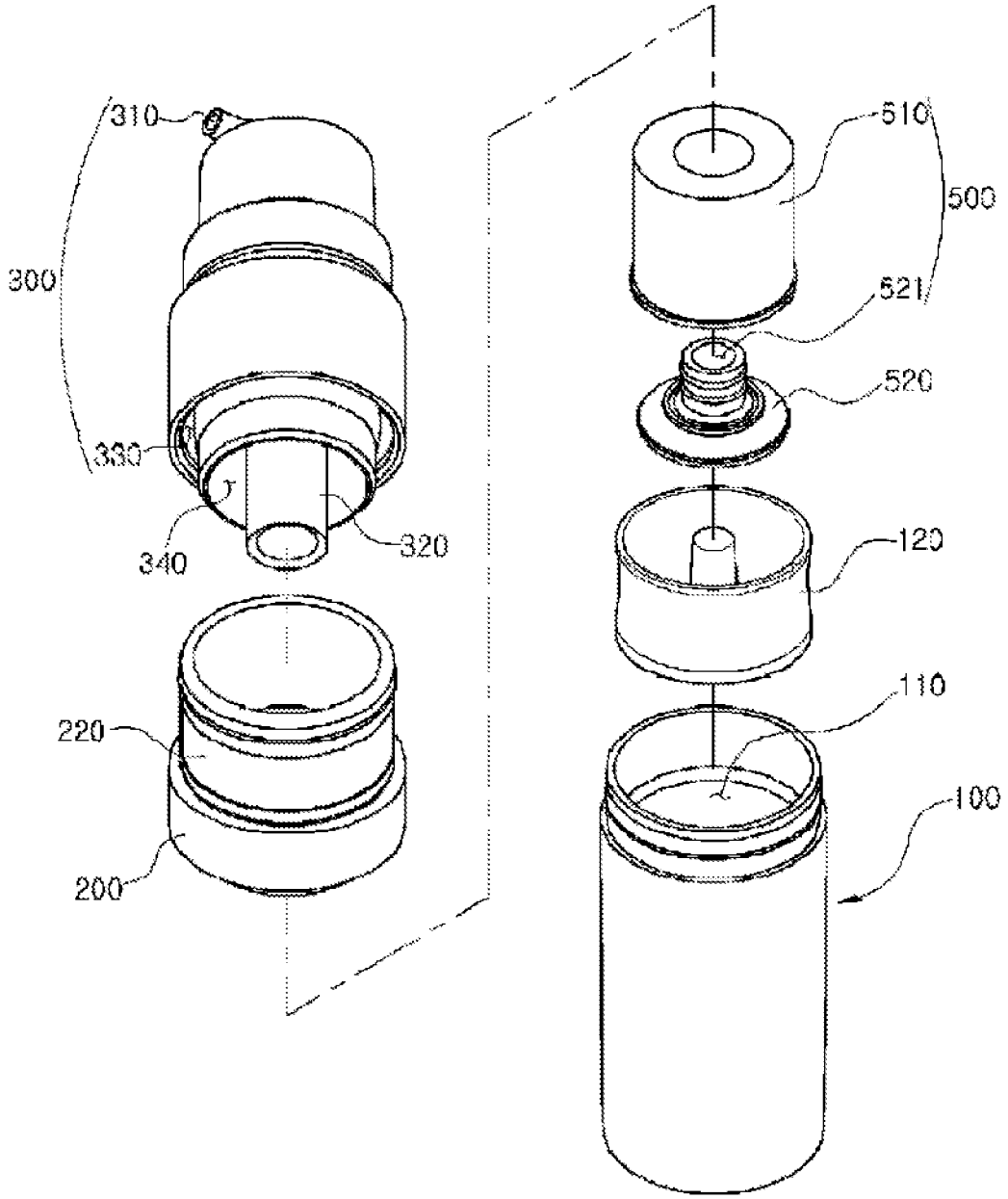
FIG. 1 is a disassembled perspective view illustrating a mixing container for different contents according to a first embodiment of the present invention.

The embodiments of the present invention will be described with reference to the accompanying drawings. The same reference numerals in the drawings represent the same elements. During the descriptions of the present invention, the descriptions on the prior at or the known constructions will be omitted so as to avoid the misunderstanding of the present invention.

The present invention has two embodiments, of which the first embodiment is directed to a container type and the second embodiment is directed to a tube type.

The present invention has features in that two kinds of contents are mixed and used. It is preferred that the content stored in the storing compartment 110 is liquid. It is preferred that the content stored in the receiver member 510 is one among liquid content different from the content stored in the storing compartment 110, powder and solid contents.

First Embodiment

The first embodiment of the present invention will be described.

Figure 2:
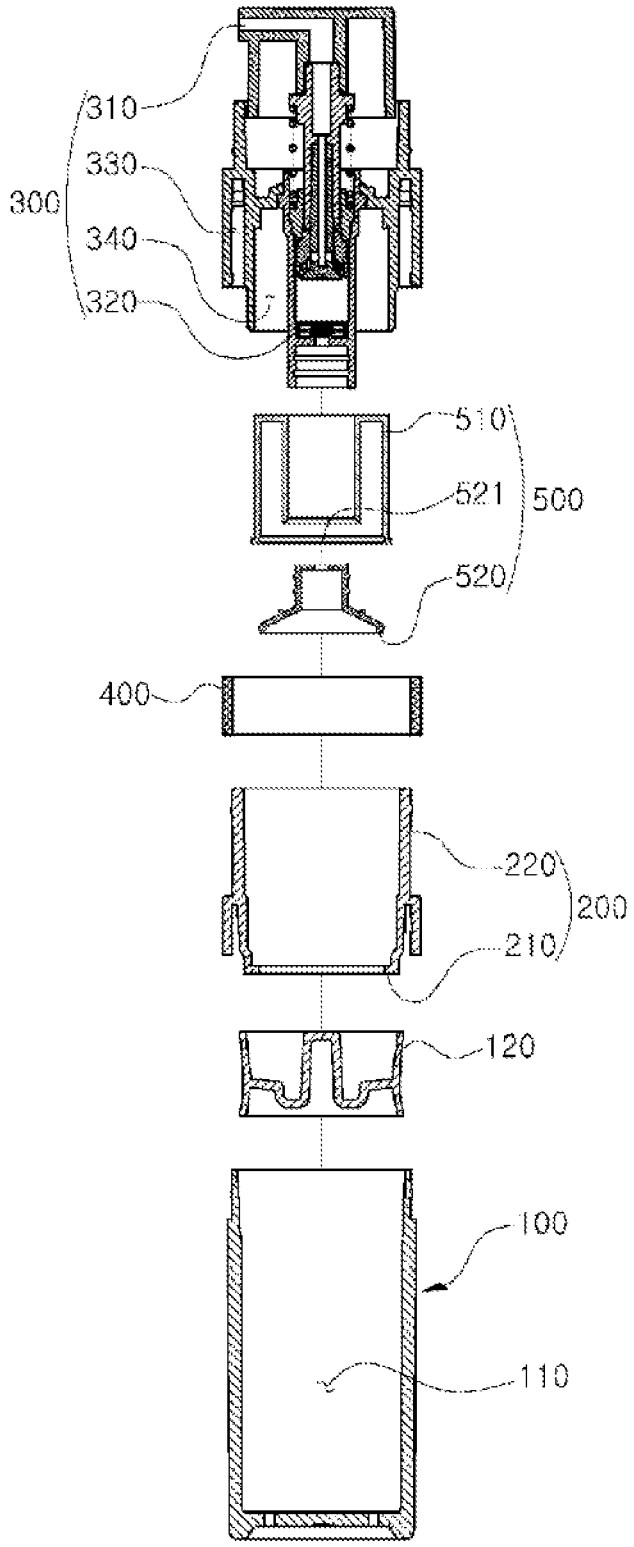
FIG. 2 is a disassembled cross sectional view illustrating a mixing container for different contents according to a first embodiment of the present invention.
Figure 3:
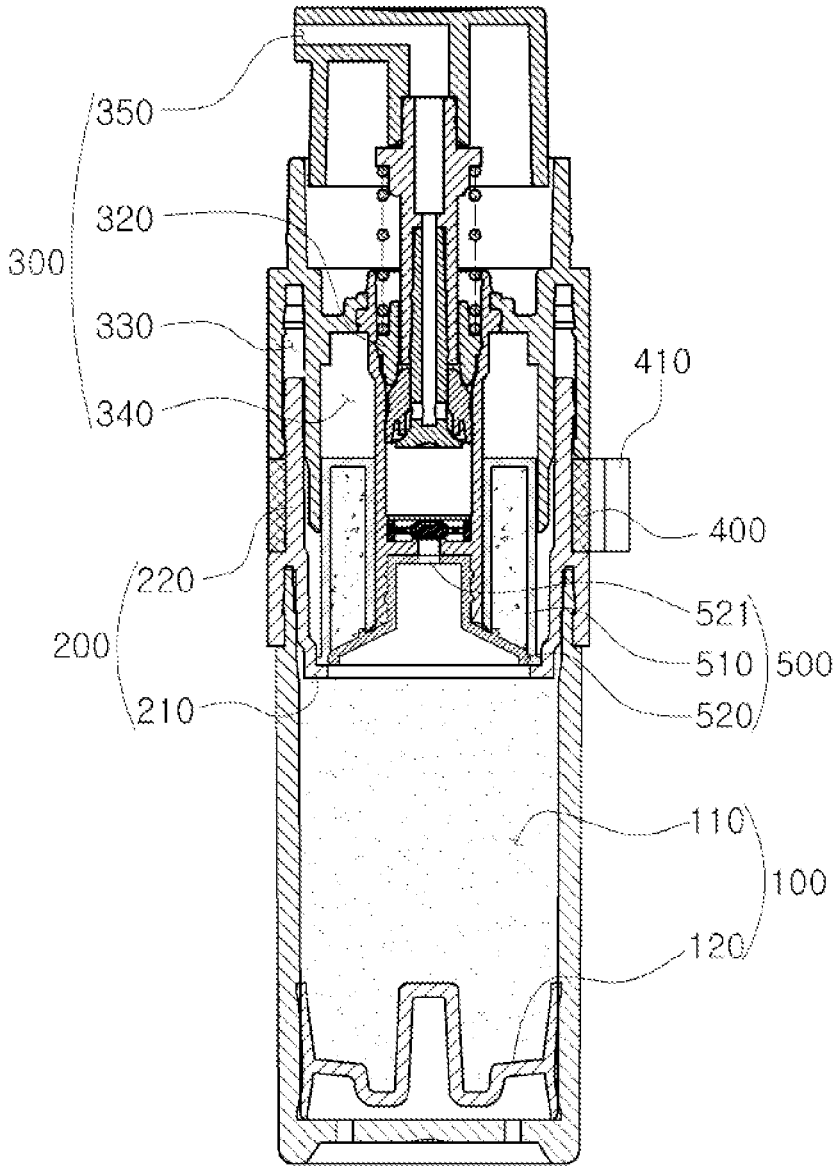
FIG. 3 is a cross sectional view illustrating an initial state of a mixing container for different contents according to a first embodiment of the present invention.
Figure 4:
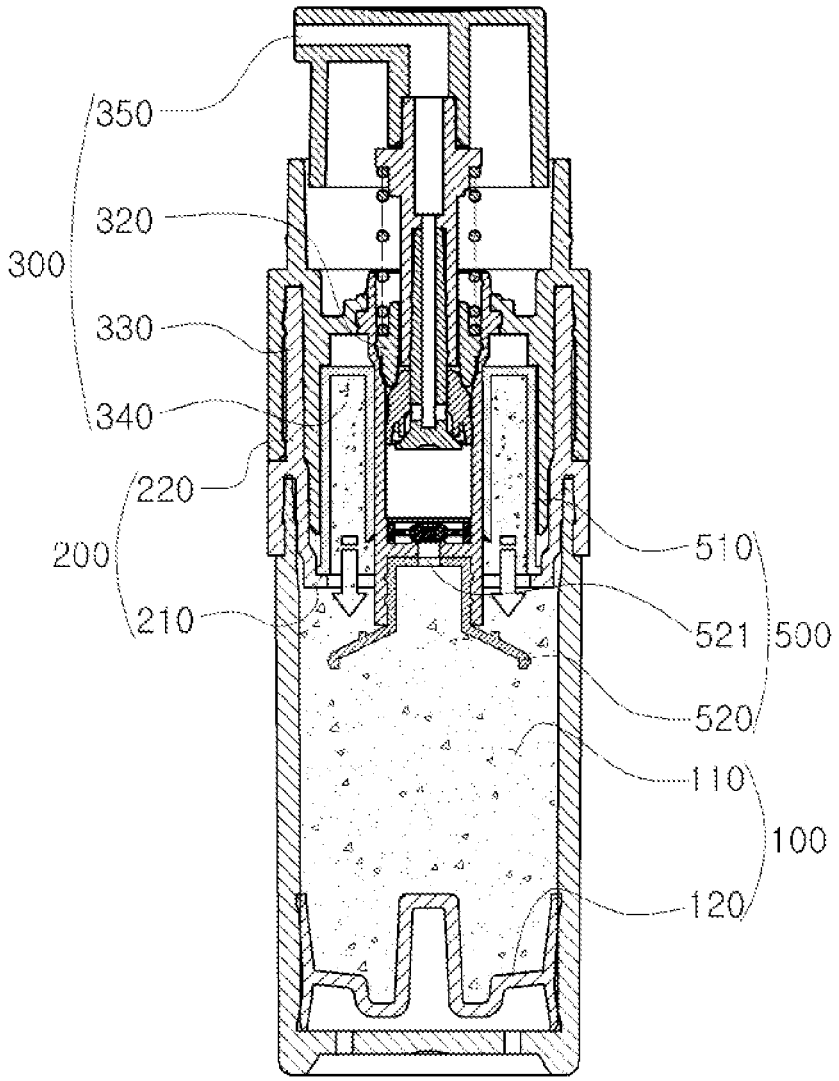
FIG. 4 is a cross sectional view illustrating a state that two contents are mixed in a mixing container for different contents according to a first embodiment of the present invention.
Figure 5:
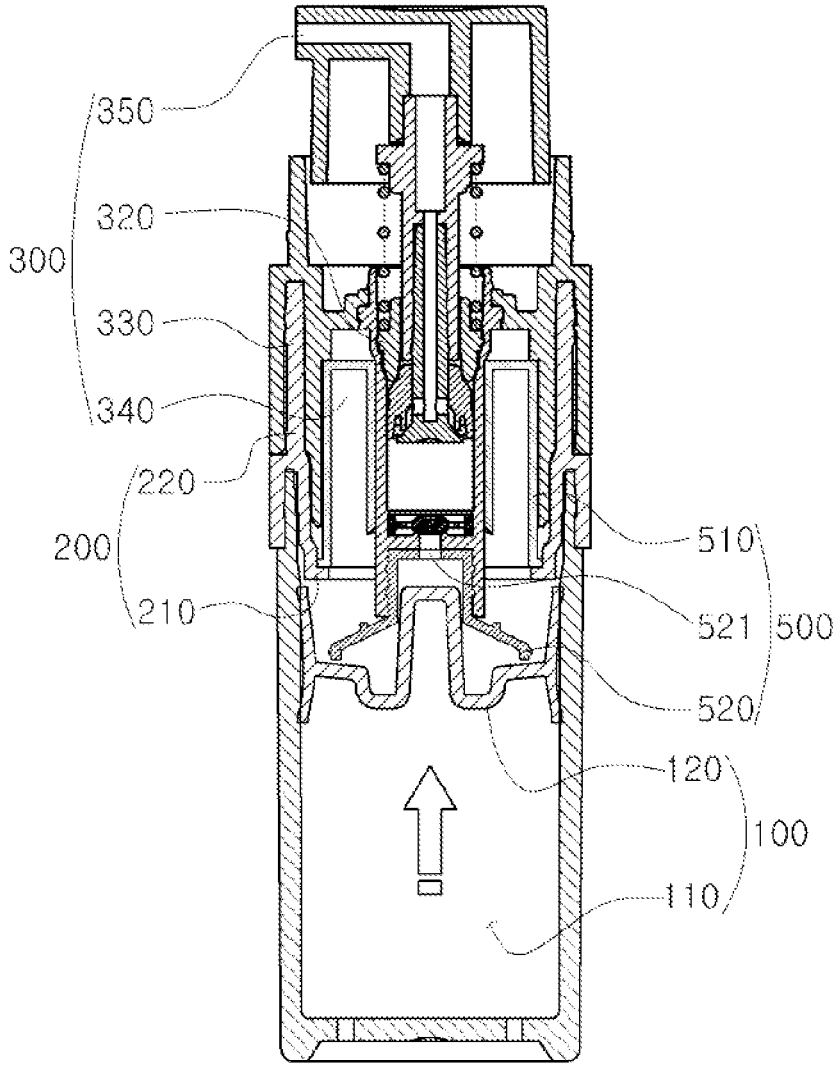
FIG. 5 is a cross sectional view illustrating a state that the piston of mixing container for different contents has moved to the top dead point according to a first embodiment of the present invention.

FIG. 1 is a disassembled perspective view illustrating a mixing container for different contents according to a first embodiment of the present invention. FIG. 2 is a disassembled cross sectional view illustrating a mixing container for different contents according to a first embodiment of the present invention. FIG. 3 is a cross sectional view illustrating an initial state of a mixing container for different contents according to a first embodiment of the present invention. FIG. 4 is a cross sectional view illustrating a state that two contents are mixed in a mixing container for different contents according to a first embodiment of the present invention. FIG. 5 is a cross sectional view illustrating a state that the piston of mixing container for different contents has moved to the top dead point according to a first embodiment of the present invention.

The mixing container for different contents according to a first embodiment of the present invention comprises a housing 100, a guide bracket 200, a button part 300, a sealing ring 400 and a storing container 500. There may be further provided a storing compartment 110, a piston 120, an engaging shoulder 210, a guide piece 220, a discharge port 310, a pumping member 320, a guide groove 330, an insertion groove 340, a parting handle 410, a receiver member 510, a sealing member 520 and a communication hole 521.

As shown in FIGS. 1 and 2, the housing 100 is a member with a storing compartment 110 storing contents, and a piston 120 is installed in the storing compartment 110. The piston 120 moves upward in contact with the inner wall of the storing compartment 110 during the pumping of the pumping member 320, thus keeping the interior of the pumping member 320 in a vacuum state.

It is preferred that the housing 100 is made from a plastic or metallic content with a certain strength high enough to keep a vacuum state.

As shown in FIGS. 1 and 2, the guide bracket 200 is a member engaged to the top of the housing 100. It is preferred that the guide bracket 200 is elastically engaged to the top of the housing 100. As shown in FIG. 2, an engaging shoulder 210 protrudes for its lower side to orient to the inner side.

As shown in FIG. 3, the engaging shoulder 210 protrudes toward the inner side of the storing compartment 110 when engaging to the housing 100.

As shown in FIGS. 1 and 2, at the top of the guide bracket 200 is provided a guide piece 220 prolonging toward the upper side. The guide piece 220 serves to guide the up and down movements of the pumping member 320.

The button part 300 is a member installed at the top of the guide bracket 200. At the button part 300 is provided a guide groove 330 engaging to the guide piece 220.

When parting the sealing ring 400, the guide groove 330 engages with the guide piece 220 for the button part 300 to drive up and down.

The button part 300 comprises a pumping member 320. The pumping member 320 is connected with the communication hole 521 of the sealing member 520 for thereby discharging the content in the interior of the housing 100 to the outside by way of the discharge port 310. The construction and operation principles of the pumping member 320 are known art, so the descriptions thereon will be omitted.

It is preferred that an insertion groove 340 the bottom of which is open is provided at the inner side of the button part 300. As shown in FIG. 2, the insertion groove 340 covers the lower outer surface of the pumping member 320.

It is preferred that the lower side of the receiver member 510 is sealingly engaged to the insertion groove 340 by means of a sealing member. At this time, it is preferred that the sealing member 520 is elastically engaged with the pumping member 320.

The sealing member 400 is a member disposed between the guide bracket 200 and the button part 300. At the initial stage, in other words, when the product of the present invention is packed, the sealing ring 400 serves to space apart the guide bracket 200 and the button part 300, and when in use, it parts for the guide bracket 200 to engage with the button part 300.

At this time, the button part 300 moves downward by means of the guide piece 220 of the guide bracket 200, and at the same time the sealing member 520 moves downward, and the content stored in the interior of the receiver member 510 and the content stored in the interior of the storing compartment 110 come to mix with each other.

In addition, the parting ring 400 consists of a parting handle 410 for easier parting work.

The accommodation container 500 is formed of a receiver member 510 storing the content which is different from the content stored in the storing compartment 110, and a sealing member 520 which is elastically engaged to the lower side of the receiver member 510.

The receiver member 510 is a member inserted in the insertion groove 340. The receiver member 510 is formed in a donut shape the lower side and center of which are open, with content being stored in the interior of the same.

As shown in FIGS. 3 to 5, the receiver member 510 is supported by the engaging shoulder 210 for its lower side not to enter the interior of the housing 100.

In addition, the sealing member 520 is a member selectively sealing the lower side of the receiver member 510. Here, the sealing member 520 serves to separate the contents stored in the interior of the sealing member 520 and stored in the storing compartment 110 when the product of the first embodiment of the present invention is not used.

The top of the sealing member 520 is engaged to the lower side of the pumping member 320. The sealing member 520 serves to open the lower side of the receiver member 510 as it moves downward by means of the button part 300 which moves when parting the sealing ring 400.

In addition, at the top of the sealing member 520 is provided a communication hole 521 communicating with the pumping member 320. With the aid of the communication hole 521, the content can discharge from the interior of the storing compartment 110 through the discharge port 310 during the pumping of the pumping member 320.

Second Embodiment

The second embodiment of the present invention will be described.

The second embodiment of the present invention has features in that the guide bracket 200 of the first embodiment is removed. In the second embodiment, the thread engagements of the housing 100 and the button part 300 are added instead of the use of the guide bracket 200.

The button part 300 of the first embodiment moves up and down by the engagements of the guide piece 220 and the guide groove 330; however the button part 300 of the second embodiment moves up and down by the thread engagement with the protrusion part 130.

Figure 6:
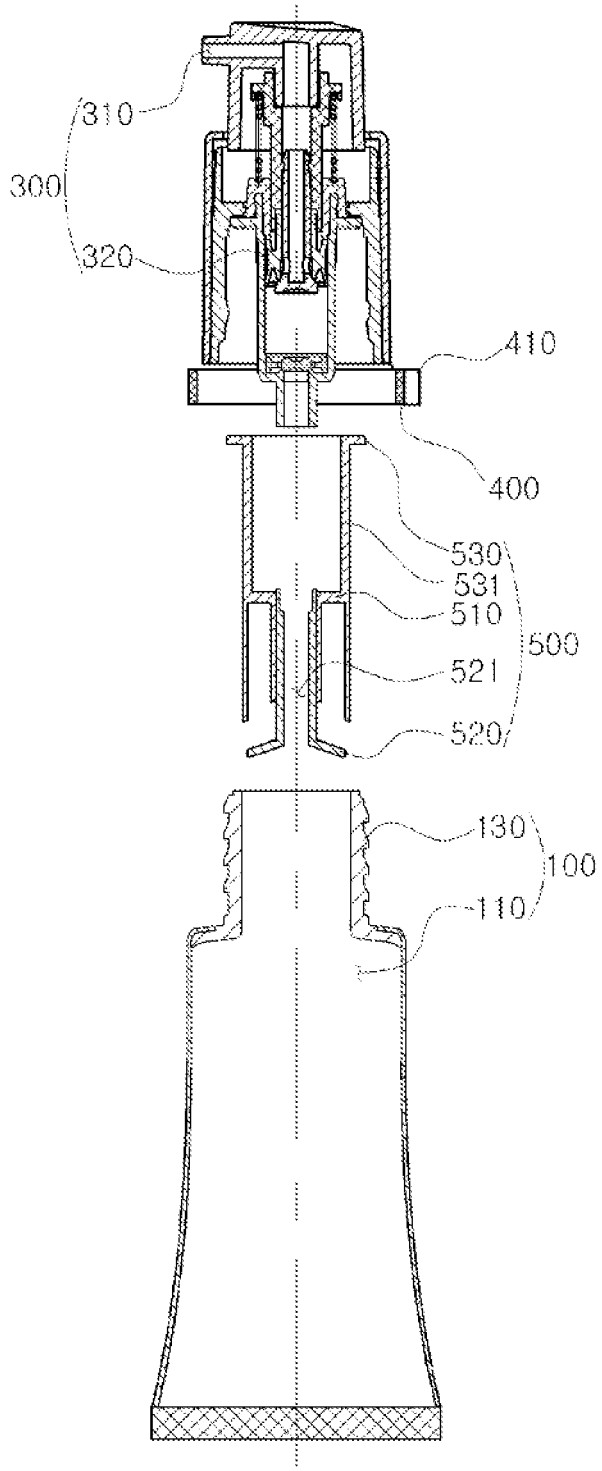
FIG. 6 is a disassembled cross sectional view illustrating a mixing container for different contents according to a second embodiment of the present invention.
Figure 7:
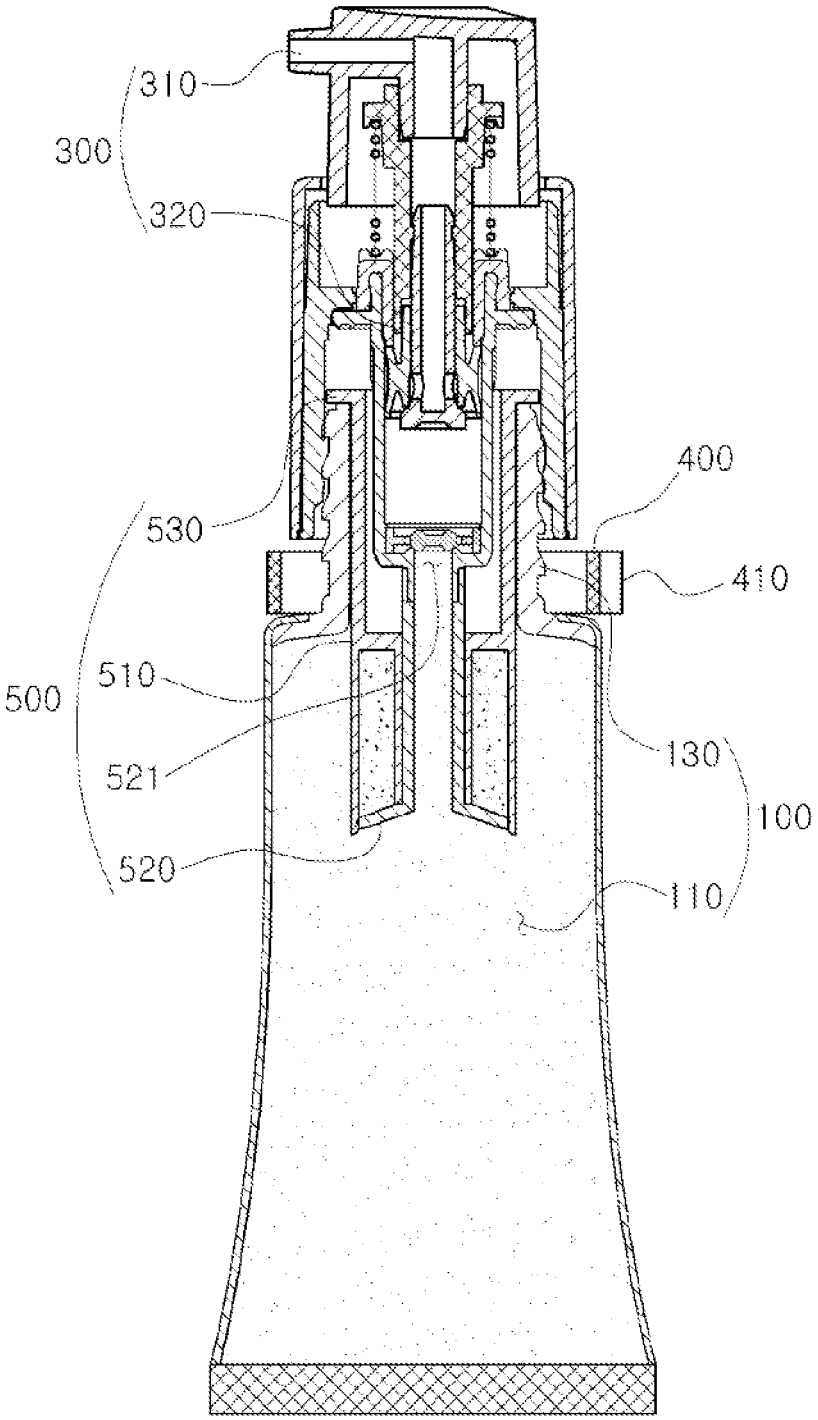
FIG. 7 is a cross sectional view illustrating an initial state of a mixing container for different contents according to a second embodiment of the present invention.
Figure 8:
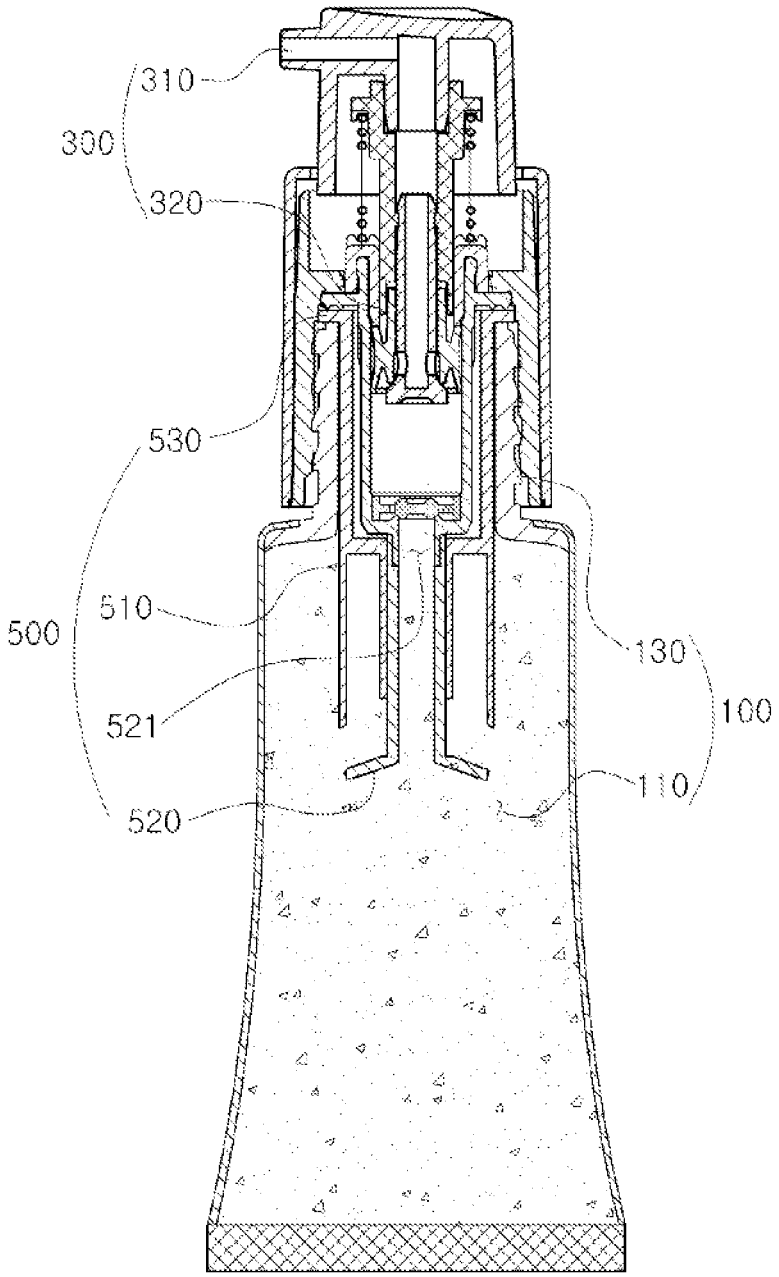
FIG. 8 is a cross sectional view illustrating a state that two contents are mixed in a mixing container for different contents according to a second embodiment of the present invention.
Figure 9:
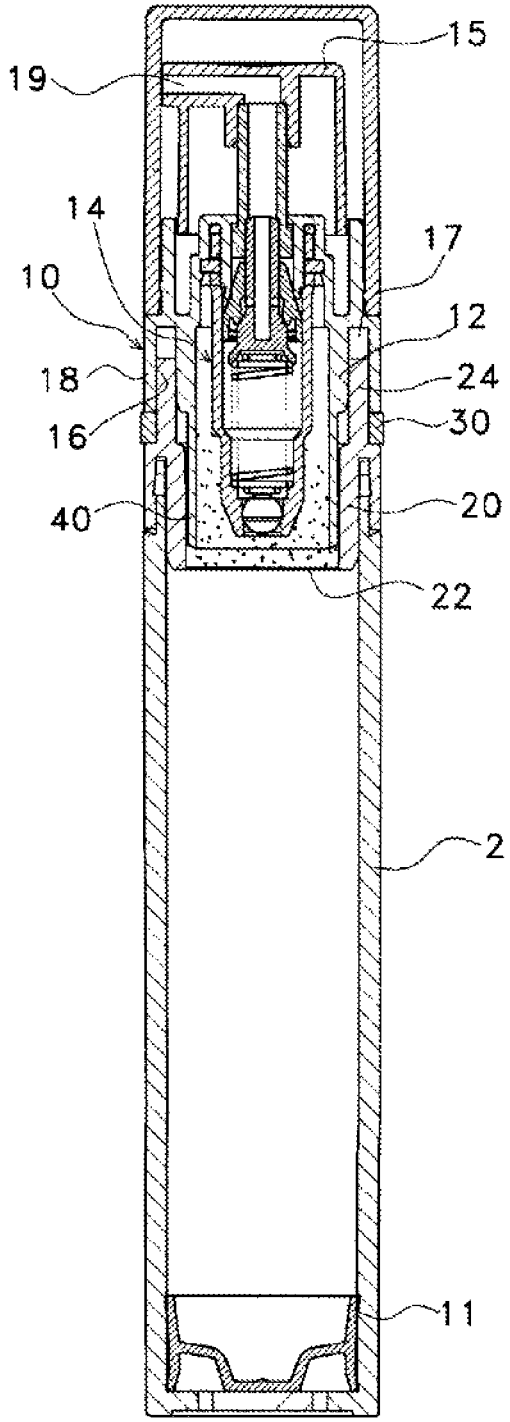
FIGS. 9 to 10 are cross sectional views illustrating a conventional mixing container for different contents.
Figure 10:
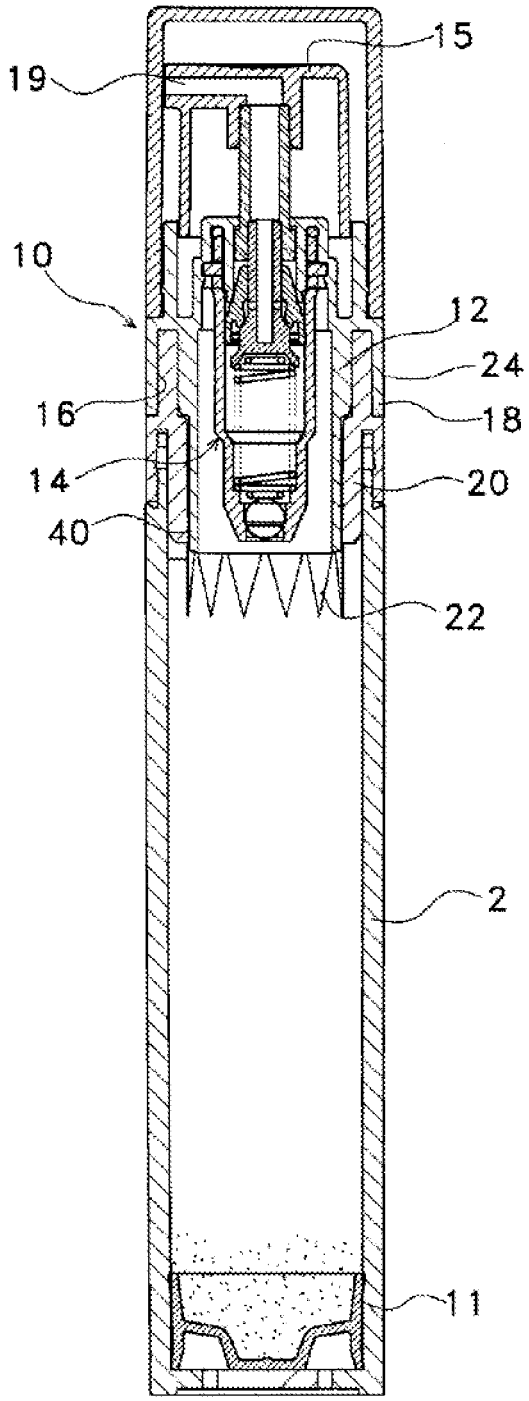

FIG. 6 is a disassembled cross sectional view illustrating a mixing container for different contents according to a second embodiment of the present invention. FIG. 7 is a cross sectional view illustrating an initial state of a mixing container for different contents according to a second embodiment of the present invention. FIG. 8 is a cross sectional view illustrating a state that two contents are mixed in a mixing container for different contents according to a second embodiment of the present invention.

The mixing container for different contents according to a second embodiment of the present invention comprises a housing 100, a button part 300, a sealing ring 400 and a storing container 500. There may be further provided a storing compartment 110, a protrusion part 130, a discharge port 310, a parting handle 410, a pumping member 320, a receiver member 510, a sealing member 520 and a fixing shoulder 530.

As shown in FIGS. 6 to 8, the housing 100 is a member with a storing compartment 110 in its interior. The member serving as the piston 120 of the first embodiment is not provided in the interior of the housing 100.

The housing 100 according to a second embodiment of the present invention is made from a flexible tube for the purpose of absorb as much contents as the discharged content amount depending on the pumping of the pumping member 320.

From the top of the housing 100 protrudes a protrusion part 130. Content may input into the protrusion part 130, and threads are formed on its outer surface.

The button part 300 is a member thread-engaged with the protrusion part 130. The button part 300 includes a discharge port 310 and a pumping member 320. The discharge port 310 and the pumping member 320 has the same functions as the discharge port 310 and the pumping member 320 of the first embodiment, so the description thereon will be omitted.

The button part 300 ascends and descends in thread engagement with the protrusion part 130. When not in use, as shown in FIG. 7, it remains spaced apart from the housing 100 by the sealing ring 400 at a certain interval, and when in use, it rotates in one direction and moves downward, and the sealing member 520 moves downward by the button part 300, thus opening the lower side of the receiver member 510.

The sealing ring 400 is a member installed between the housing 100 and the button part 300. As shown in FIG. 7, at the initial stage, in other words, the product of the present invention is packed, when not in use, the housing 100 and the button part 300 are spaced apart from each other, and when in use the button part 300 moves downward.

At this time, the button part 300 is thread-engaged with the threads of the protrusion part 130 and moves downward, and at the same time the sealing member 520 moves downward, so the content stored in the interior of the receiver member 510 and the content stored in the interior of the storing compartment 110 come to mix with each other.

It is preferred that the sealing ring 400 is equipped with a parting handle 410 for the sake of easier parting work.

As shown in FIG. 6, the storing container 500 comprises a fixing shoulder 530 protruding outward to be caught by an upper outer portion of the protrusion part 130 at the top of the same, an extension part 531 extending downward from the fixing shoulder 530, an accommodation part 510 storing the content different from the content stored in the storing compartment 110, and a sealing member 520 elastically connected to the lower side of the receiver member 510.

The fixing shoulder 530 serves to fix the receiver member 510 and the sealing member 520 in places in the interior of the housing.

The receiver member 510 is a member positioned in the interior of the housing 100 and is formed in a donut shape the lower and center sides of which are open, with the contents being stored in the interior of the same.

The sealing member 520 is a member selectively sealing the lower side of the receiver member 510. When not in use, it helps separate the content stored in the interior of the sealing member 520 and the content stored in the storing compartment 110.

The top of the sealing member 520 is engaged with the lower side of the pumping member 320. The sealing member 520 descends with the aid of the button part 300 which descends in the parting direction of the sealing ring 400, thus opening the lower side of the receiver member 510.

At the top of the sealing member 520 is formed a communication hole 521 communicating with the pumping member 320. When pumping using the pumping member 320, the content stored in the interior of the storing compartment 110 can discharge through the discharge port 310 through the communication hole 521.

The operations that two contents are mixed according to the present invention will be described with reference to FIGS. 3 to 5.

Referring to the first embodiment of FIGS. 3 to 5, those skilled in the art can fully understand the second embodiment of the present invention shown in FIGS. 7 and 8, the descriptions on the operations that two contents of the second embodiment of the present invention mix with each other will be omitted.

FIG. 3 shows the initial state of the mixing container for different contents according to a first embodiment of the present invention. In the initial state, the content stored in the storing compartment 110 and the content stored in the receiver member 510 keep separate by the sealing member 520.

In the initial state, the contents stored in the storing compartment 110 and the receiver member 510 don't mix with each other.

In the above mentioned initial state, the user parts the sealing ring 400 with holding the parting handle 410, and the button part 300 is pressurized in the downward direction. The button part 300 descends along the guide piece 220, and it changes from the initial state of FIG. 3 to the state of FIG. 4.

When the button part 300 descends, the sealing member 520 descends by the pumping member 320, and the lower side of the receiver member 510 is opened. The content stored in the receiver member 510 comes into the storing compartment 110 and comes to mix with.

The user lightly swings upward and downward holding the housing, so two contents mix well.

The user light sways holding two contents, and the user pressurizes the button part 300 for the sake of pumping work. When pumped, the interior of the housing 100 comes to vacuum, so the piston 120 ascends as long as the amount discharged through the discharge port 310. When the content stored in the storing compartment 110 is all discharged out, as shown in FIG. 5, the piston 120 comes to positioned at the top dead point.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A mixing container for different contents, comprising:

a housing that includes a storing compartment storing first contents and a piston installed within the storing compartment;

a guide bracket engaged to the top of the housing, the guide bracket including an engaging shoulder protruding toward an inside of the storing compartment and a guide piece disposed on the engaging shoulder and extending upward;

a button part operating as it engages with the guide piece and including a pumping member for discharging contents through a discharge port;

a sealing ring installed between the guide bracket and the button part to selectively part the guide bracket and the button part; and a storing container, wherein the storing container comprises:

a receiver member that is installed at the button part and contains second contents different from the first contents stored in the storing compartment, a lower side of the receiver member being supported by the engaging shoulder; and a sealing member that selectively seals the lower side of the receiver member and is engaged to a lower side of the pumping member; and a communication hole allowing the pumping member and the storing compartment to communicate during the pumping of the pumping member, wherein, the sealing member is in a fixed position without moving after the sealing ring is parted.

2. The container of claim 1, wherein the button part comprises:

a guide groove that is engaged with the guide piece and has an opened lower side to move up and down; and an insertion groove having a lower side that is open, wherein the receiver member is inserted in the insertion groove.

3. The container of claim 1, wherein the first contents stored in the storing compartment is liquid, and the second contents stored in the receiver member is one among a liquid, a powder and a solid.

4. The container of claim 1, wherein, when in use, the sealing ring is parted and the sealing member moves downward so that the guide bracket engages with the button part.

5. The container of claim 1, wherein, when the button part moves downward, the sealing member moves downward so that the lower side of the receiver member is open and the second contents mix with the first contents.

* * * * *